United States Patent [19]

Salani

[11] Patent Number: 4,621,871

[45] Date of Patent: Nov. 11, 1986

[54] QUICKLY REPLACEABLE CUTTER SOCKET

[75] Inventor: C. Ranjan Salani, Springfield, Ohio

[73] Assignee: Koehring Company, Milwaukee, Wis.

[21] Appl. No.: 746,350

[22] Filed: Jun. 19, 1985

[51] Int. Cl.[4] ..... E21C 25/12

[52] U.S. Cl. ..... 299/91; 299/92; 299/93; 299/95

[58] Field of Search ..... 299/91, 92, 93, 95; 37/141 T, 142 R, 142 A

[56] References Cited

U.S. PATENT DOCUMENTS 4,275,929 6/1981 Krekeler ..... 299/91

4,343,516 8/1982 Aden ..... 299/91 X

*Primary Examiner*—Stephen J. Novosad

*Assistant Examiner*—Thomas J. Odar

*Attorney, Agent, or Firm*—Ziems, Walter & Shannon

[57] ABSTRACT

A mounting for quickly removing and replacing cutter teeth on a rotary drum includes a cutter tooth socket mating with a socket housing defining a tapered channel having a base surface and a lateral surfaces inclined with respect to the longitudinal axis of the tapered channel and oriented at an acute angle with respect to the base surface to retain the cutter tooth socket by a wedging action. The cutter tooth socket is also retained on the socket housing by a spring retainer seated in a recess in the base surface and engaging a protrusion depending in a groove defined by the cutter tooth socket. A leading side of the cutter tooth socket with respect to the direction of cutter movement contains oblique surfaces to cam to the side the material of the surface being cut. A dummy cap is inserted in socket housings from which the cutter teeth sockets have been removed and extends beyond the socket housings toward the surface being cut to protect the socket housings from wear by the work surface.

17 Claims, 5 Drawing Figures

34
32
10
70
74
12
72
38
36
68
66
62
60
55
56
52
58
54
16
64
14
A

QUICKLY REPLACEABLE CUTTER SOCKET

DESCRIPTION

1. Technical Field

The present invention relates to machines such as recyclers, planers, stabilizers, pulverizers, and rotary cutters which employ cutting teeth mounted on a drum which is rotated by a mechanical, hydraulic or electrical device. More particularly, the invention relates to quickly removable and replaceable sockets for mounting cutting teeth to the drum.

The machines described are used for cutting asphalt, concrete and soil, and due to the large forces involved and the abrasion of the materials being cut, the sockets for mounting the cutting teeth wear out in a short time, thereby requiring removal and replacement. Ordinarily, the sockets are welded directly to the drum or are welded to blocks or spacers which are in turn welded to the drum. Replacement of such sockets requires cutting the old socket, grinding and cleaning the surface of the drum, blocks or spacers, and accurately positioning the new socket and welding it in place. Such an operation is not only very time consuming, but also requires removal of the cutter drum assembly from the machine and transportation of the assembly to a shop to perform the work. Thus, the cost of replacement of the teeth is very expensive, and the down time of the machine and resultant work delays are also very costly.

Furthermore, it has been found that different numbers of cutting teeth are desired to provide the greatest efficiency for different types of cutting jobs. For example, it has been found that a smaller number of cutting teeth increases the cutting speed and, thus, the productivity of the machine, so that field contractors tend to use as small a number of teeth as possible to meet the gradation requirements for recycling, whereas for planing, the accuracy of depth and surface finish are more important, and more cutting teeth having a smaller spacing are desired. However, because of the trouble involved in adding or removing teeth, contractors use a less than optimum number of teeth for a given job, or they cut the teeth in the field for one job and reweld them for another job at great time and expense, or they use different drum assemblies for different jobs. Furthermore, the rotary drums are equipped with teeth for producing a cut of a predetermined width, but cut widths smaller than the predetermined widths are sometimes needed, thereby requiring a rotary drum change or the time-consuming removal of some teeth.

2. Background Art

It has been proposed to attach tooth sockets with bolts to render them more removable, but some of the bolt designs have encountered problems due to wear of the bolt heads, making it extremely difficult to remove the bolts. Even where the bolt heads are not worn, the removal and replacement of the bolts is time consuming.

Another removable tooth socket arrangement is disclosed in U.S. Pat. No. 4,275,929 issued to Krekeler, in which a cutter bit mounting lug is slidably received in a base member to secure the lug to the driven element of a mining machine. Numerous embodiments are disclosed, each of which includes a lug and base member configured so as to have a wedging engagement and a retaining device to prevent undesired disengagement. In the embodiment illustrated in FIGS. 6 and 7, a lug has lateral extensions which taper rearwardly and toward each other and the disclosure specifies that the lateral extensions are received within bifurcations which are of the same vertical dimensions throughout their length, resulting in a side-to-side wedging action between the lug and the base member rather than a vertical wedging action. To assure that the lateral extensions will fit under the bifurcations, the lug and the base member must be manufactured with tolerances which will permit some play between the upper horizontal surfaces of the extensions and the lower horizontal surfaces of the bifurcations. Such play results in frequent shifting and movement of the lug with respect to the base member and greater stress on some portions of the horizontal surfaces of the lateral extensions and bifurcations, both of which lead to premature wear of both parts. In the embodiment illustrated in FIGS. 15–17, the lug includes a lower body portion having a circular cross section and uniform taper throughout its length. The lower body portion is received in a base portion having a sloped lower wall portion, causing the distance between the cutter and the driven element to which it is mounted to vary depending on the depth of entry of the lower body portion into the base portion before wedging occurs.

SUMMARY OF THE INVENTION

The mounting arrangement for cutter teeth according to the present invention allows the quick removal and replacement of cutter tooth sockets, while providing a positive and precise mounting of the cutter sockets without play. In addition, the sockets are shaped to reduce wear from the material of the surfaces they cut. Furthermore, protection is provided for socket housings in applications where the cutter sockets are removed.

In order to accomplish the objects of the invention, the tooth socket according to the present invention includes a base portion having a central depending foot which is tapered in two orthogonal directions and a socket housing, more permanently secured to a cutter drum, which receives the foot in a tapered channel complementary to the foot. The tapered channel is defined in part by a base surface parallel to the surface of the rotary drum at its mounting position so that the distance between the cutter tooth and the rotary drum is constant regardless of the depth of insertion of the tooth socket base into the tapered channel. The uniformity of this distance for all of the cutter teeth on a rotary drum is important especially in planing and recycling operations where precision in the depth of the cut is essential. The foot of the tooth socket is retained in the tapered channel by a spring retainer having a seat portion accommodated in a recess in the base surface and a narrower detent portion which engages a depending protrusion defined in a slot on the underside of the foot. The slot is narrower than the seat portion of the spring retainer in order to overlie and hold the spring retainer in the recess as the foot is moved into position in the tapered channel.

The tooth socket has a leading side with respect to the direction of cutter tooth movement which includes a surface oblique with respect to a plane defined by the direction of cutter tooth movement and the axis of a shank of the tooth socket extending from the base portion to a cutter tooth receiving portion. In one preferred embodiment, the leading side of the cutter socket includes a diamond shape having a pair of oblique surfaces inclined rearwardly and to the side. A dummy cap having an insert portion substantially the size and shape of the foot of the cutter tooth socket is received and retained in the socket housing when a cutter tooth is not desired at a particular location on the rotary drum. The insert portion prevents the engagement of abrasive material with the surfaces of the housing recess and, thereby, prevents the wear of the socket housing, and the dummy cap includes a cap portion extending beyond the socket housing to contact the surface being cut by the remaining cutters and to thereby protect the socket housing.

DETAILED DESCRIPTION OF THE PREFERRED EMBODIMENT OF THE INVENTION

Figure 1:
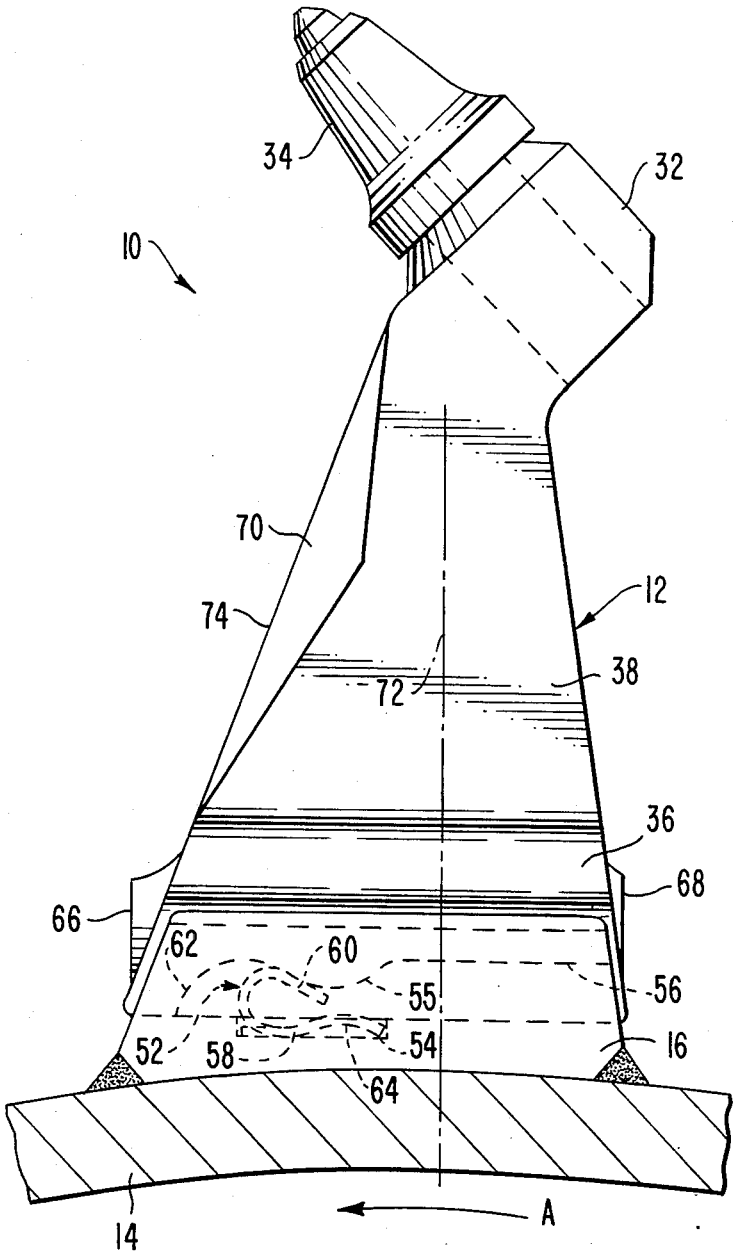
FIG. 1 is a side view of a removable mounting, in accordance with the present invention, of a cutter tooth to a rotating drum.

In FIG. 1, the reference numeral 10 designates generally an exemplary embodiment of the mounting according to the present invention for cutter teeth, including a quickly replaceable cutter tooth socket 12. The mounting 10 is shown in position on a power driven support, for example, a rotary drum 14 of a machine such as a recycler, planer, stabilizer, pulverizer, or rotary cutter. The mounting 10 includes a receptacle in the form of a socket housing 16 which is securely fixed to the rotary drum 14 by welding or other suitable means of attachment. The socket housing defines an interior space in the form of a central tapered channel 18 (FIG. 2) extending in a direction generally tangent to the rotary drum 14 at the area of the rotary drum to which the socket housing 16 is fixed. The tapered channel 18 has its greatest width at the end of the socket housing 16 which is the leading end with respect to the direction of rotary drum rotation, which is indicated in FIG. 1 by the arrow A.

Figure 2:
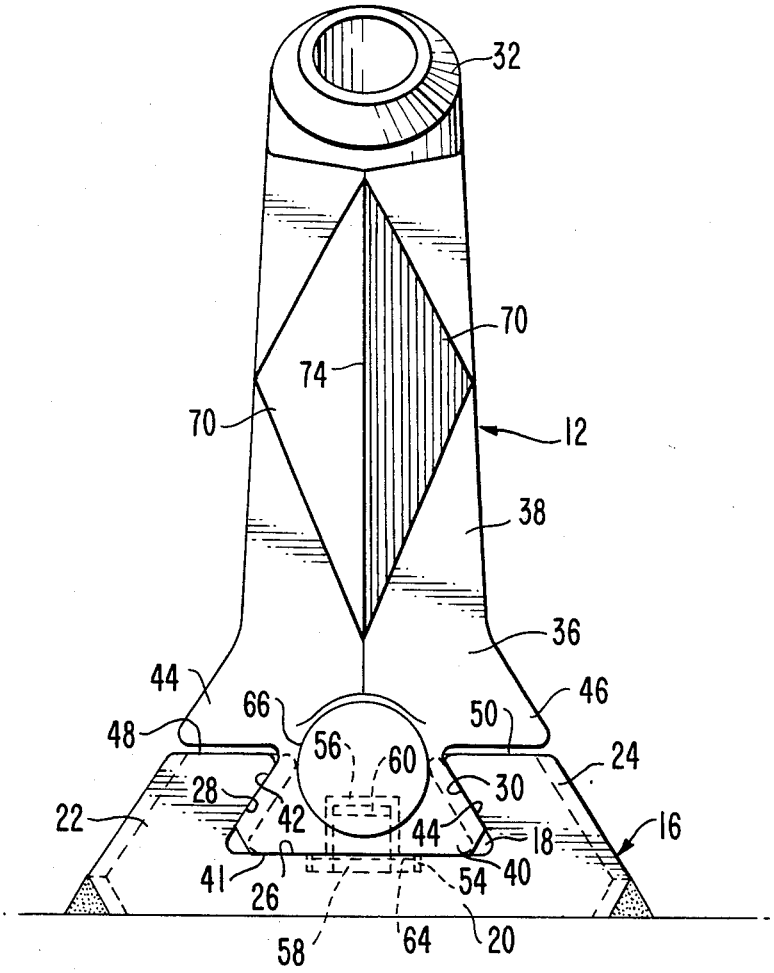
FIG. 2 is a front view of the mounting of FIG. 1, with the cutter tooth removed.
Figure 3:
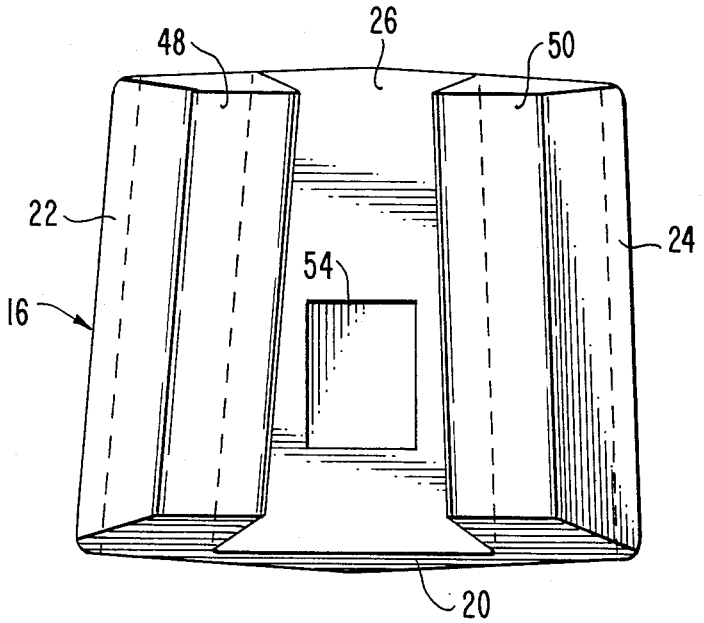
FIG. 3 is a plan view of the socket housing from the mounting of FIG. 1.

As can best be seen from FIGS. 2 and 3, the socket housing 16 includes a base portion 20 and opposed lateral walls 22 and 24. The tapered channel 18 is defined by a base surface 26 on the base portion 20 and lateral surfaces 28 and 30 on the interior sides of the opposed lateral walls 22 and 24, respectively. The lateral surfaces 28 and 30 are inclined toward the longitudinal axis of the tapered channel 18 from its leading end with respect to the direction of cutter movement to its trailing end, and they are oriented at an acute angle with respect to the base surface 26. The cutter tooth socket 12 includes a cutter tooth receiving portion 32 for holding a cutter tooth 34 (FIG. 1) or other form of cutter, a base portion 36 for connection to the socket housing 16, and a shank portion 38 extending between the base portion 36 and the cutter tooth receiving portion 32. The base portion 36 includes a central depending foot 40 having a shape complementary to the tapered channel 18 of the socket housing 16 for reception in the tapered channel with a tight wedging fit. The central depending foot 40 has a bottom surface 41 parallel to the base surface 26 of the socket housing 16 and side surfaces 42 and 44 which are inclined from a leading side of the cutter tooth socket 12 to its trailing side at the same angle at which the lateral surfaces 28 and 30 of the socket housing lateral walls 22 and 24 taper from its leading surface to its trailing surface. In addition, the side surfaces 42 and 44 of the foot 40 are inclined toward the bottom surface 41 of the foot at the same angle at which the lateral surfaces 28 and 30 of the socket housing walls 22 and 24 are inclined toward the longitudinal axis of the tapered channel 18. Thus, movement of the cutter tooth socket 12 into the socket housing 16 results in an even, wedging fit between the side surfaces 42 and 44 of the depending foot 40 and the mating surfaces of the socket housing walls along two directions transverse to the longitudinal axis of the tapered channel 18—along a direction parallel to the base surface 26 of the foot 40 and along a direction perpendicular to the base surface. As a result, forces acting on the cutter tooth 34 by the surface being cut, which have a component along the longitudinal axis of the tapered channel 18 and in a direction opposite the rotation of the rotary drum 14, as indicated by the arrow A, are countered by the wedging engagement of the foot 40 with the tapered channel 18, and the wedging fit is made even tighter by such forces. The tapering of the tapered channel 18 and of the foot 40 from the leading end of the socket housing 16 to the trailing end creates a wedging fit which prevents yawing of the cutter tooth socket 12 around an axis perpendicular to the base surface 26 of the socket housing 16, and the orientation of the lateral surfaces 28 and 30 of the tapered channel 18 and the side surfaces 42 and 44 of the foot 40 toward the base surface 26 prevents pitching of the cutter tooth socket 12 around an axis parallel to the base surface 26 and perpendicular to the longitudinal axis of the socket housing 16. The inward orientation also eliminates rolling of the cutter tooth socket 12 around an axis parallel to the longitudinal axis of the tapered channel 18.

The base surface 26 is parallel, or tangent, to the surface of the rotary drum 14 so that the distance between the cutter tooth 34 and the rotary drum is constant, regardless of the extent of insertion of the foot 40 of cutter tooth socket 12 into the tapered channel 18 of the socket housing 16. Thus, despite varying amounts of wear among the cutter tooth sockets 12 and socket housings 16 on a rotary drum 14, all of the cutter teeth 34 will be spaced from the rotary drum 14 by precisely the same distance, thereby assuring evenness in the cutting operation being performed.

Lateral projections 44 and 46 extending from the base portion 36 of the cutter tooth socket 12, above the depending foot 40, cooperate with upper surfaces 48 and 50 on the lateral walls 22 and 24 of the socket housing 16 to provide resistance against deflection of the cutter tooth socket 12 to a point of bending or failure due to occasional extreme forces. The cutter tooth socket 12 and the socket housing 16 are dimensioned to provide a space between the lower surfaces of lateral projections and the upper surfaces 48 and 50 on the lateral walls 22 and 24. This space, which is exaggerated in the drawings, assures clearance between the just mentioned surfaces and requires some deflection of the cutter tooth socket 12 before the surfaces engage.

Figure 4:
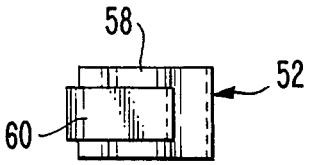
FIG. 4 is a plan view of the spring retainer from the mounting of FIG. 1.

As can be seen from FIGS. 1, 2 and 4, in addition to the wedging action, the cutter tooth socket 12 is retained in the socket housing 16 by a spring retainer 52, which can be made entirely of resilient material. The spring retainer 52 seats in a recess 54 in the base surface 26 of the base portion 20 of the socket housing 16 and engages a protrusion 55 depending from the top surface of a slot 56 defined in the central depending foot 40 along its longitudinal axis, the slot having an open end and a closed end, as can best be seen from FIGS. 1 and 2. The spring retainer 52 has a seat portion 58 which is received in the recess and a narrower detent portion 60 which curves upwardly from the seat portion and extends back over the seat portion. As the cutter tooth socket 12 is slid into the tapered channel 18, the open end of the slot 56 passes over the detent portion 60 of the spring retainer 52, followed by the depending protrusion 55 which deforms the spring retainer, and then allows the spring retainer to return to an expanded position, in which the depending protrusion 55 traps the detent portion in a pocket 62 defined in the slot 56 between the depending protrusion and the closed end. The slot 56 is narrower than the seat portion 58 of the spring retainer 52 so that movement of the foot 40 over the base surface 26 of the socket housing 16 holds the spring retainer 52 in place in the recess 54 in order to prevent the spring retainer from being forced out of position by the depending protrusion 55. The seat portion 60 curves upwardly in a section 64 to extend above the base surface 26 of the socket housing 16 when it is in its relaxed state. The bottom surface 41 of the foot 40 along opposite sides of the slot 56 depresses the section 64 and deforms the seat portion 58 of the spring retainer 52 to hold it snugly in the recess 54, thereby avoiding wobbling of the spring retainer. Although the section 64 would actually be depressed when the cutter tooth socket 12 is in place in the socket housing, the spring retainer 52 has been shown in its relaxed state in FIG. 1 to illustrate the extent by which the section 64 would project above the base surface 26.

Insertion and removal of the cutter tooth socket 12 with respect to the socket housing 16 ordinarily requires striking the cutter tooth socket 12 with a hammer, and so surfaces 66 and 68 orthogonal to the sliding direction of the cutter tooth socket are provided on the leading and trailing sides of the base portion 36 of the cutter tooth socket to receive the hammer blows.

In order to reduce wear on the cutter tooth socket 12 by the material being cut, the leading side of the cutter tooth socket with respect to the direction of cutter movement has surfaces 70 oblique with respect to a plane defined by the direction of cutter movement and an axis 72 of the shank portion 38 extending between the base portion 36 and the cutter tooth receiving portion 32. In the embodiment illustrated in FIGS. 1 and 2, the shank portion has a leading longitudinal edge 74 and a pair of oblique surfaces 70, each having a triangular shape with one leg coincident with the leading longitudinal edge 74 so as to define an oblique portion of the leading side in the shape of a diamond. The oblique surfaces 70 reduce the force of the work surface against the leading side of the cutter tooth socket 12 by camming the material to the side like a knife. Although the diamond shape has been specifically described and illustrated, it is understood that other oblique surfaces may be used.

Figure 5:
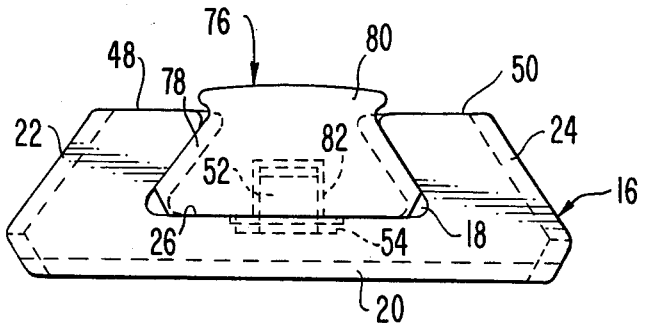
FIG. 5 is a front view of the socket housing of FIG. 3 having a dummy cap in place.

When cutting teeth are removed to reduce the tooth density of the rotary drum 14 or to narrow its cutting swath, the socket housings 16 remain and are subject to the same type of abrasive wear which the cutter tooth sockets 12 encounter. Such wear tends to change the configuration and dimensions of the socket housings 16, including the surfaces defining the tapered recesses, which destroys the proper fit between the depending feet 40 of the tooth sockets 12 and the tapered channels 18 of the socket housings. In addition, the empty tapered channels 18 lead to the packing of hard abrasive material which must be cleaned out of the tapered channels before cutter tooth sockets 12 may be reinstalled. In order to avoid these problems, as is illustrated in FIG. 5, the present invention includes a dummy cap 76 to extend beyond the socket housing 16 toward the surface being cut and to fill the tapered channel 18 in the absence of the cutter tooth socket 12 to prevent the ingress of abrasive material. The dummy cap 76 has an insert portion 78 which corresponds in size and shape to the central depending foot 40 of the cutter tooth socket 12 and a cap portion 80 which extends beyond the upper surfaces 48 and 50 of the socket housing lateral walls 22 and 24 to contact the surface being cut by remaining cutter teeth and, thereby, to keep the socket housing 16 spaced from the work surface, protecting it. A groove 82 and a depending protrusion like those of the central depending foot 40 of the cutter tooth socket 12 are also provided.

While the invention has been particularly shown and described with respect to a preferred embodiment thereof, it will be understood by those skilled in the art that the foregoing and other changes in form and details may be made therein without departing from the spirit and scope of the invention.

Having thus described my invention, what I claim as new, and desire to secure by Letters Patent is:

1. Apparatus for removably mounting a cutter on a support for movement in a predetermined direction to cut a work surface, comprising:

a socket for receiving the cutter, and a receptacle secured to the movable support for receiving the socket, said receptacle having means for defining a tapered channel having a longitudinal axis generally parallel to said predetermined direction of cutter movement, wherein said means for defining a tapered channel comprises a base surface and lateral surfaces defining an angle with the longitudinal axis of said tapered channel and being oriented at an acute angle with respect to said base surface, said socket has mating surfaces engaging and parallel to said base surface and said lateral surfaces of the tapered channel, whereby pitching, rolling and yawing of said socket relative to said receptacle are prevented, and said base surface is parallel to said predetermined direction of cutter movement, whereby the distance between said cutter and said support is constant regardless of the extent of insertion of said socket into said receptacle.

2. Apparatus according to claim 1, wherein said tapered channel has a leading end and a trailing end with respect to said predetermined direction of cutter movement, and said tapered channel is wider at said leading end than at said trailing end.

3. Apparatus according to claim 1, wherein said socket has a cutter receiving portion, a receptacle engaging portion, and a shank having a leading side with respect to said predetermined direction of cutter movement and defining an axis between said cutter receiving portion and said receptacle engaging portion; said shank axis and said predetermined direction of cutter movement define a plane, and said leading side of said shank is defined by at least one surface oblique to said plane.

4. Apparatus according to claim 1, wherein said socket has a depending foot, and said mating surfaces of the socket are defined on said depending foot.

5. Apparatus according to claim 4, wherein said lateral surfaces of said receptacle are on receptacle walls having upper surfaces, and said socket has lateral projections defining lower surfaces parallel to and adjacent to the upper surfaces of said receptacle walls.

6. Apparatus according to claim 1, further comprising means for retaining said socket in said receptacle, said retaining means comprising a spring retainer engaging said socket and said receptacle.

7. Apparatus according to claim 6, wherein said spring retainer has a seat portion and a detent portion extending from said seat portion, said base surface of the tapered channel includes a recess receiving the seat portion of said spring retainer, and said socket has a protrusion engaging the detent portion of the spring retainer.

8. Apparatus according to claim 7, further comprising means for confining the seat portion of said spring retainer in said recess as said socket is inserted into said receptacle.

9. Apparatus according to claim 7, wherein the seat portion of the spring retainer is wider than the detent portion, said protrusion of the socket is in a slot defined in the surface of the socket mating with the base surface of the tapered channel, and said slot is wider than the detent portion of the spring retainer and narrower than the seat portion, whereby said surface of the socket mating with the base surface of the tapered channel confines the seat portion of the spring retainer in said recess as said socket is inserted into said receptacle.

10. Apparatus according to claim 9, wherein the seat portion of the spring retainer is made of a resilient material and has a section extending out of said recess beyond said base surface of the tapered channel, and said surface of the socket mating with said base surface engages and deforms said section of said seat portion and prevents wobbling of said seat portion in said recess.

11. Apparatus according to claim 7, wherein a slot is defined in the socket, said slot having an open end and a closed end, said protrusion is in said slot between said open end and said closed end and defines a pocket with said closed end, and the detent portion of the spring retainer is received in said pocket.

12. Apparatus according to claim 1, wherein said socket has a leading end and a trailing end with respect to said predetermined direction of cutter movement, and each of said leading end and said trailing end has a striking surface orthogonal to said predetermined direction to receive blows for aiding the insertion and removal of the socket with respect to the receptacle.

13. Apparatus according to claim 1, wherein said socket defines a longitudinal axis extending between said socket and the cutter and defining a plane with the predetermined direction of cutter movement, and said socket has a leading side with respect to said predetermined direction.

14. In combination, a receptacle for removably mounting a cutter on a support for movement in a predetermined direction to cut a work surface, said receptacle receiving a cutter holder, and means for preventing said receptacle contacting said work surface when said cutter holder is removed, said contact preventing means comprising an element extending beyond said receptacle in a direction away from said support.

15. Apparatus according to claim 14, wherein said receptacle defines an interior space, and said element includes an insert portion filling said interior space.

16. The apparatus of claim 14, wherein said receptacle includes means for defining a tapered channel having a longitudinal axis generally parallel to said predetermined direction, said means for defining a tapered channel comprising a base surface and lateral surfaces inclined with respect to the longitudinal axis of said tapered channel and oriented at an acute angle with respect to said base surface, and said element has an insert portion having mating surfaces engaging and parallel to said base surface and said lateral surfaces of the tapered channel.

17. The apparatus of claim 16, further comprising means for retaining said element in said receptacle, said retaining means comprising a spring retainer engaging said element and said receptacle.

* * * * *